United States Patent [19]

Shaw

[11] 4,385,595

[45] May 31, 1983

[54] BOTTOM STOP CYLINDER LINER AND ENGINE ASSEMBLY

[75] Inventor: Terrence M. Shaw, Columbus, Ind.

[73] Assignee: Cummins Engine Company, Inc., Columbus, Ind.

[21] Appl. No.: 214,702

[22] Filed: Dec. 9, 1980

[51] Int. Cl.[3] ..... F02F 1/16

[52] U.S. Cl. ..... 123/41.84; 123/193 C

[58] Field of Search ..... 123/41.71, 41.81, 41.83, 123/41.84, 193 C, 193 CH, 668, 669; 92/171

[56] References Cited

U.S. PATENT DOCUMENTS

| | | | |
|---|---|---|---|
| 1,862,321 | 6/1932 | Sass | 123/41.78 |
| 2,474,878 | 7/1949 | Winfield | 123/41.82 R |
| 2,721,542 | 10/1955 | Sheppard | 123/193 C |
| 2,783,749 | 3/1957 | Effmann | 123/41.83 |
| 3,046,953 | 7/1962 | Dolza | 92/147 |
| 3,315,573 | 4/1967 | de Coye de Castelet | 92/171 |
| 3,403,661 | 10/1968 | Valentine et al. | 123/41.84 |
| 3,628,427 | 12/1971 | Bailey | 123/193 CH |
| 3,769,880 | 11/1973 | Mirjanic | 123/193 C |
| 3,882,842 | 5/1975 | Bailey et al. | 123/193 C |
| 4,202,310 | 5/1980 | Zorrilla et al. | 123/41.84 |
| 4,244,330 | 1/1981 | Baugh et al. | 123/41.84 |

FOREIGN PATENT DOCUMENTS

| | | | |
|---|---|---|---|
| 1576404 | of 0000 | Fed. Rep. of Germany | 123/193 C |
| 2140378 | of 0000 | Fed. Rep. of Germany . | |
| 1043913 | of 0000 | France . | |
| 1116882 | of 0000 | France . | |
| 615045 | of 0000 | United Kingdom . | |

*Primary Examiner*—William A. Cuchlinski, Jr.

*Attorney, Agent, or Firm*—Sixbey, Friedman & Leedom

[57] ABSTRACT

A bottom stop liner for use in an engine block and head assembly including a radially directed surface adjacent the inner end of the liner for engaging a liner stop and a radial press fit at the outer end of the liner combined with a resilient liner body integral with and extending between the inner and outer ends operating to apply axial spring force between the liner stop and the head of the engine to place the portion of the head block surrounding a cylinder cavity in which the liner is placed under tensile force as the head is connected to the engine block and moved into operative position. The liner body is designed to have an axial compliance which is greater than the axial compliance of the surrounding portion of the engine block. The desired compliance characteristics are achieved by providing the liner body with an uniform minimal radial wall thickness along a substantial inner portion of the total axial length thereof and by providing a radial wall thickness which increases with increased axial distance from the inner end of the liner in proportion to the upper limit of gas pressure to which the interior of the cylinder liner is subjected only along a relatively smaller outer axial portion of the liner. The block walls surrounding each cylinder cavity are relatively uniform in radial thickness and the outer surfaces join tangentially to cause adjacent cylinder cavities to be separated by a distance equal to twice the cylinder wall thickness. Moreover, the end walls of the cylinder block and the liner support flanges are formed to maintain circumferentially uniform compliance in the liner supporting portion of the cylinder block. A head gasket having a high friction body for reducing wear and a combustion seal ring having a high non-resilient deformation characteristic is provided to complement the unique liner/block design.

22 Claims, 13 Drawing Figures

J-BLOCK PROTRUSION SENSITIVITY

BOTTOM STOP CYLINDER LINER AND ENGINE ASSEMBLY

DESCRIPTION

1. Technical Field

This invention relates to cylinder liners for internal combustion engines particularly of the compression ignition type.

2. Background Art

Despite the long recognized advantages associated with the use of cylinder liners in internal combustion engines, and the innumerable design variations which have been tested, an optimum liner design has yet to be disclosed. The most conventional design, known as a top stop liner, has generally involved provision of a cylindrical body with a radially extending flange located at the upper end of the liner for being sealed in a counterbored recess in the cylinder cavity of the engine block so that the liner may be clamped into place by the engine head. If the liner is to be liquid cooled, a seal is normally formed between the engine block and a lower (inner) portion of the liner to form a coolant jacket around the liner. A liner of this type is disclosed in U.S. Pat. No. 3,403,661. Due to vibration and thermally induced size changes of the liner, relative motion occurs in the seal area of a type which would destroy conventionally known seals. This is particularly true since coolant passages are normally formed in a manner to cause particles within the coolant to collect in the seal area and eventually work between the sealed surfaces resulting in seal destruction.

Other serious defects attend the use of top stop liners. For example, top stop flanges are fairly non compliant and thus require very close manufacturing tolerance. When the flange thickness in the axial direction of the liner body is excessive, structural failure may occur, such as cracking of the liner flange, block counterbore or cylinder head. Alternatively, insufficient flange length will prevent the attainment of sufficient combustion gas seal pressure. Inherently, the short axial length of the top stop flange causes the flange to have a low compliance in comparison to the remaining portion of the bolted head/block/gasket structure. Accordingly, excessive alternating loads are induced in the liner as variations in the combustion chamber gas pressure tend to load and unload the top stop flange leading to deleterious relative movement between the top stop flange and the internal surface of the engine block counterbore which receives the top stop flange. Low compliance of the top stop flange can also cause very high alternating strain in the normally more compliant combustion gasket and can lead to low combustion seal life.

While not as common, cylinder liner designs have been disclosed wherein the radial stop flange is positioned below the upper (outer) end of the liner. Examples of such liners are illustrated in U.S. Pat. Nos. 2,474,878, 3,315,573, and 3,628,427; German Pat. No. 2,140,378, French Pat. Nos. 1,043,913 and 1,116,882 and British Pat. No. 615,045. It has even been proposed to move the liner stop nearly all of the way to the bottom of the liner as illustrated in U.S. Pat. No. 3,882,842 and in some instances to use the bottom (inner) face of the liner as the liner stop as illustrated in U.S. Pat. Nos. 2,783,749 and 3,046,953. Most of these mid and bottom stop liner disclosures have in no way focused on the compliance characteristics of the resulting head/block/liner/gasket assembly in order to overcome the deficiencies of the more conventional top stop liner as discussed above. While the deficiencies which result from the inherent non-compliance of a top stop flange are overcome to some degree by placing the stop at a lower position on the cylinder body and by adjusting the cylinder block, accordingly, other factors such as thermal growth come into play which overshadow the benefits which could otherwise be derived.

In an attempt to deal with thermally induced size changes, U.S. Pat. Nos. 3,315,573 and 3,882,842 employ complicated and excessive composite liner structures which attempt to eliminate differential thermal growth between the liner and block or to compensate for its existence. The near bottom stop configuration of U.S. Pat. No. 3,882,842 is actually merely a mid stop liner combined with a separate outer concentric sleeve which operates as a stiff spring to accommodate thermal expansion and contraction of the cylinder liner. While useful for the purpose disclosed, the liner disclosed in U.S. Pat. No. 3,882,842 is exceedingly expensive to manufacture and requires a resilient annular member in combination with the stiff spring sleeve to impart the compliance characteristics which are desired to accommodate thermally induced size changes in the body of the cylinder liner.

Numerous liner/block designs have been disclosed wherein the liner body includes wall thicknesses which increase near the top of the liner such as in U.S. Pat. No. 1,862,321, U.S. Pat. No. 3,769,880 and German Pat. No. 1,576,404. However, none of these references discloses a bottom stop liner having controlled wall thicknesses to provide desired compliance characteristics. Clearly, no optimum liner design has been disclosed which allows for the inexpensive manufacture of a reliable liner capable of overcoming the deficiencies of the top stop liner as discussed above.

DISCLOSURE OF THE INVENTION

It is an object of this invention to overcome the deficiencies of the prior art as discussed above and in particular to provide an engine block and cylinder liner assembly in which the relative compliances of the engine block and cylinder liner are controlled to lessen the incidence of structural deformity and/or cracking in the assembly, improve the combustion gas seal integrity, reduce head bolt fatigue, and reduce head/block liner wear.

Another object of the subject invention is to provide a bottom stop liner having a radial press fit at the upper (outer) end which substantially reduces axial contraint at the upper end relative to the engine block and to provide a liner having greater compliance than the surrounding portion of the engine block to cause combustion induced loads to be transmitted through the engine block.

Still another object of the subject invention is to provide a bottom stop cylinder liner wherein the bottom (inner) face of the liner is employed for engaging a liner support flange in a manner to avoid inducing bending forces in the liner wall.

Still another object of the subject invention is to provide a full bottom stop liner having a minimal wall thickness in order to maximize the liner compliance and in particular to provide a full bottom stop liner having a uniform minimal wall thickness along a substantial portion of the entire axial length of the liner and an increasing wall thickness adjacent the upper (outer) end of the liner corresponding roughly to the maximum combustion gas pressure to which the corresponding portion of the cylinder liner is subjected.

Yet another object of the subject invention is to provide a full bottom stop liner design including a radial press fit at the top (upper) end of the liner for forming a coolant seal and to provide radial support to the portion of the liner subjected to the greatest combustion gas pressure. The full length of the liner is used to achieve significantly greater circumferential uniformity in the combustion gas seal pressure applied between the uppermost (outermost) end of the liner and the engine head. In particular, the distance between the combustion gas seal and the threaded connection of the head bolts with the engine block is maximized by utilizing the full length of the cylinder liner and the surrounding portions of the engine block between the threaded connection of the head bolts and the liner support flange (liner stop) located adjacent the bottom of the cylinder liner.

Still another object of the subject invention is to provide a cylinder liner and an engine block assembly wherein the liner compliance is sufficiently greater than the compliance of the block placed under tension by the compression loading of the liner to cause a relatively larger portion of the combustion loads changes to be biased through the engine block than through the liner body and combustion seal thereby reducing alternating combustion induced strains in the combustion gas seal ring of the head gasket.

It is yet another object of the subject invention to provide an engine block having plural cylinder cavities in which the walls defining the cylinder cavities are provided with a uniform circumferential compliance. The block walls surrounding each cylinder cavity are relatively uniform in radial thickness and the outer surfaces join tangentially to cause adjacent cylinder cavities to be separated by a distance equal to twice the cylinder wall thickness. The end walls of the cylinder block and the liner support flanges (liner stops) in the end cylinder cavities are formed to maintain circumferentially uniform compliance in the liner supporting portions of the cylinder block between the head engaging surface and the liner stops within the end cylinder cavities and to provide uniform compliance characteristics between the head engaging surface and each of the main bearing caps of the block.

A still more specific object of the subject invention is to provide a bottom stop liner in combination with an engine block and head assembly including a head gasket having a high friction body for reducing wear and a combustion seal ring between the uppermost (outermost) end of the cylinder liner and the engine head characterized by a high non-resilient deformation characteristic which forms an apparent high assembly compliance when the head is moved into an operative position relative to the engine block and a resilient deformation characteristic which forms a rebound operating compliance substantially less than the assembly compliance and substantially less than the axial compliance of the cylinder liner. By this structural characteristic of the gasket, a practical tolerance can be employed in the manufacture of the full bottom stop liner of the subject invention and the thermal growth and wear characteristics of the liner may be fully accomodated without detrimental effect to the combustion gas seal.

Still another and more specific object of the subject invention may be appreciated from the following Brief Description of the Drawings and the Best Mode For Carrying Out the Invention.

BEST MODE FOR CARRYING OUT THE INVENTION

Figure 1:
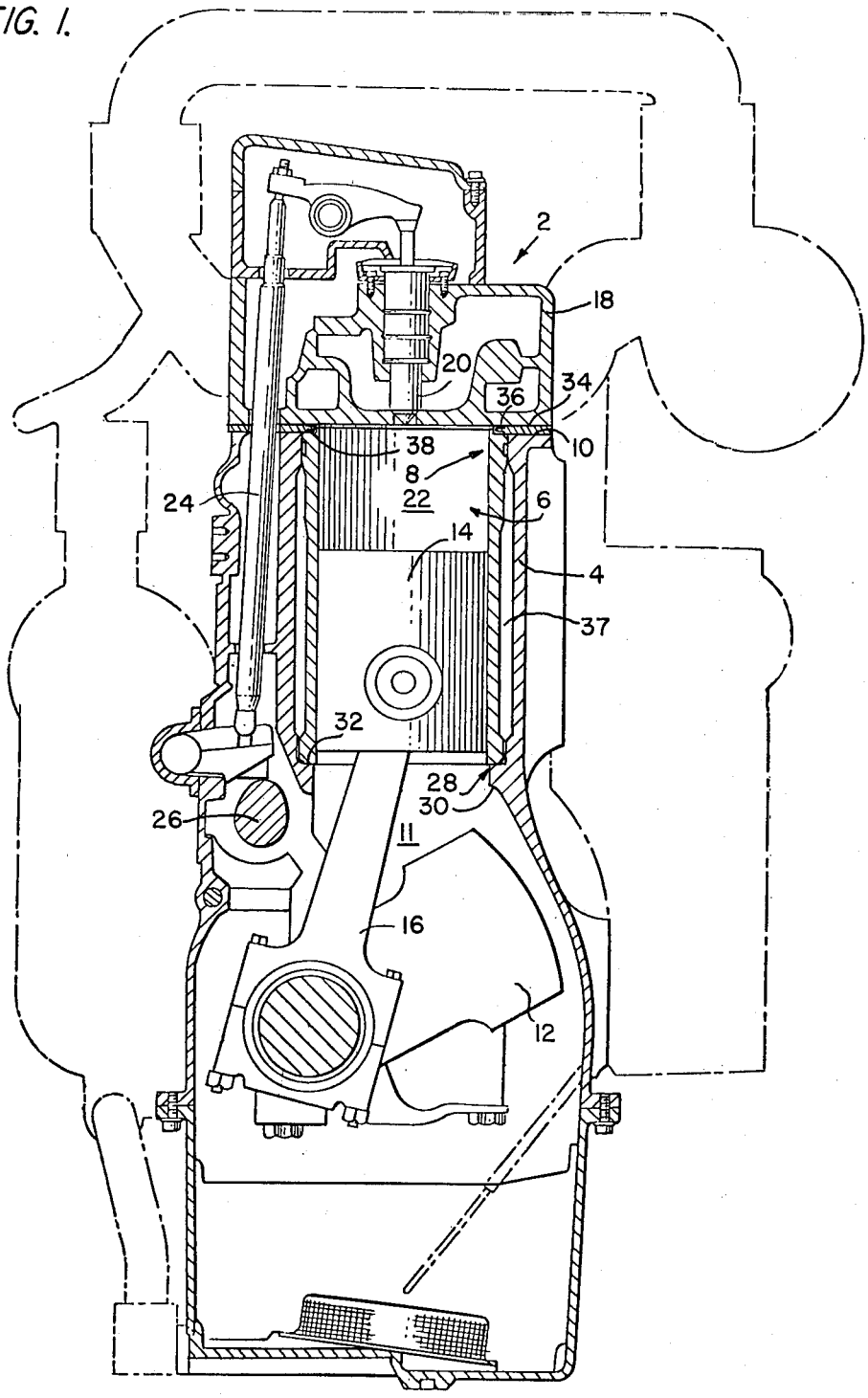
FIG. 1 is a cross sectional view of an internal combustion engine including a cylinder liner and engine block designed in accordance with the subject invention.

Reference is initially made to FIG. 1 in which an internal combustion engine embodying the subject invention is illustrated including an engine block 4 containing a cylinder cavity 6 in which is disposed a bottom stop cylinder liner 8. The cylinder cavity 6 extends between the top deck or head engaging surface 10 formed on the top side of engine block 4 and a cavity 11 of the engine block in which the crankshaft 12 is mounted for rotation. The interior surface of liner 8 is cylindrical in configuration and functions to guide the reciprocating motion of an engine piston 14 attached to the crankshaft 12 by means of a connecting rod 16. Engine block 4 includes a plurality of cylinder cavities, only one of which is illustrated in FIG. 1, within which additional pistons connected to the crankshaft 12 are disposed for reciprocating motion. For purposes of this discussion, the direction and orientation of components will be described with reference to the crankshaft 12; thus, "outward" and "inward" will be used to mean away from and toward the crankshaft 12, respectively.

FIG. 1 additionally illustrates a removable engine head 18 containing a fuel injector 20, intake and exhaust passages, and valves (not illustrated) for controlling gas flow into and out of combustion chamber 22 formed between the head 18 and the upper surface of piston 14 within cylinder liner 8. An injector train 24 is connected at one end to the fuel injector 20 and at the other end to the camshaft 26 driven by crankshaft 12 to synchronize operation of the injector 26 with movement of piston 14.

As will be discussed in greater detail hereinbelow, the cylinder liner is held under a compressive load by head 18 at one end and by a liner stop 28 located at the opposte end of cylinder cavity 6. Liner stop 28 is formed by a radially inwardly directed flange 30 having an upper surface which is generally perpendicular to the longitudinal axis of the cylinder cavity 6 and which is positioned to engage the innermost face 32 of the cylinder liner 8. The cross-sectional contour of the cylinder wall is carefully controlled in accordance with the subject invention to provide the maximum possible cylinder liner compliance consistent with the need to limit liner distortion due to gas pressure within the combustion chamber 22.

The upper end of cylinder liner 8 is radially positioned within the cylinder cavity by means of a radial press fit between the outer end of the liner 8 and a corresponding portion of the cylinder cavity 6. This arrangement substantially reduces axial constraint at the outer end of cylinder liner 8 and the corresponding portions of the engine block 4 and causes the compliance of the liner to be distributed throughout the entire axial length thereof. The portion of the engine block between liner stop 28 and engine head 18 which is placed under a tensile load by the compressed liner is designed to have a compliance which is distributed uniformly throughout the portions of the cylinder block surrounding the cylinder cavity 6. By designing the cylinder liner 8 to have a substantially greater compliance than the above noted portions of the cylinder block 4, the load changes induced in the system by combustion pressure will be generally concentrated in the engine block portion and will produce minimal alternating strains in the head gasket seal ring. As will be developed in greater detail hereinbelow, a practical implementation of the subject invention requires very careful control of the compliance characteristics of the head gasket 34 disposed between head engaging surface 10 and the engine head 18. Gasket 34 includes a combustion seal ring 36 disposed between the outermost end face 38 of cylinder liner 8 and the adjacent surface of head 18. As head 18 is pulled into its operative postion by means of a plurality of head bolts, extending through head 18 and threadedly engaged in the engine block 4 not illustrated, the combustion gas seal ring 36 is compressed to apply an approximately uniform axial compressive force to the outermost end face 38 of liner 8.

As clearly shown in FIG. 1, the inside surface of cavity 6 and the outside surface of liner 8 are recessed to form a liquid coolant passage 37. During engine operation liquid coolant is supplied to passage 37 to cool the exterior surface of liner 8.

To understand the design considerations that resulted in the cylinder liner and block assembly design illustrated in FIG. 1, reference will be made to FIG. 2 in which a model of the elastic bolted joint construction of a liner/engine block/head/head gasket joint assembly is disclosed. This model allows the determination of the influence of all the various components in the bolted joint with regard to assembly loads, load changes during combustion, and relative motions which could contribute to wear. The labelled spring-like elements represent the compliances existent within the corresponding structural element. Arrows labelled P represent the combustion gas pressure loads induced within the combustion chamber of an assembly of the type illustrated in FIG. 1. $P_1$ represents the load resulting from combustion gas pressure within the combustion chamber operating on the portion of the upper end of cylinder liner 8 which is not covered by the combustion gas seal ring 36. $P_2$ represents the load imposed on the head 18 by gas pressure operating on the small annular surface between the point of contact of the lower surface of head 18 with combustion gas seal ring 36 and the projected interior cylindrical surface of the cylinder liner 8.

Figure 2:
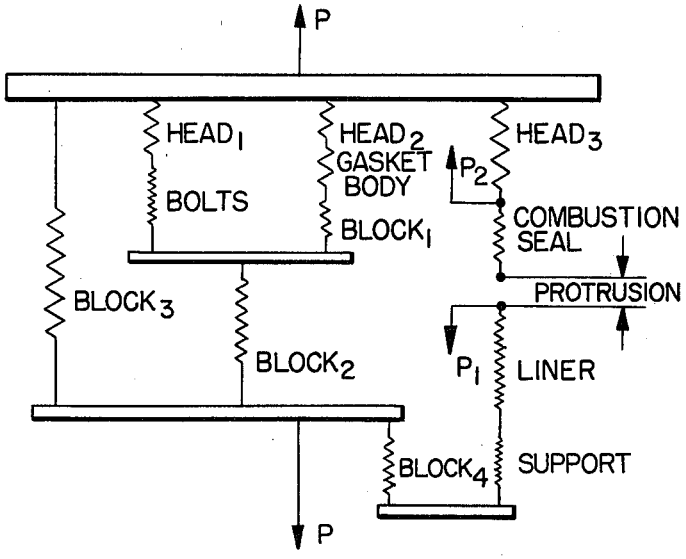
FIG. 2 is a diagrammatic illustration of an elastic bolted joint model for a liner/block/head/head gasket assembly.
Figure 3:
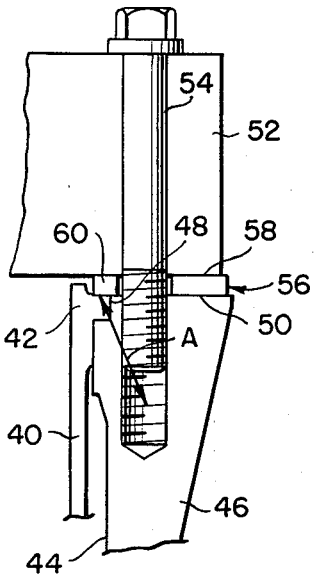
FIG. 3. (PRIOR ART)
FIG. 3 is a partially broken away cross sectional view of a prior art top stop liner and engine block assembly.
Figure 4:
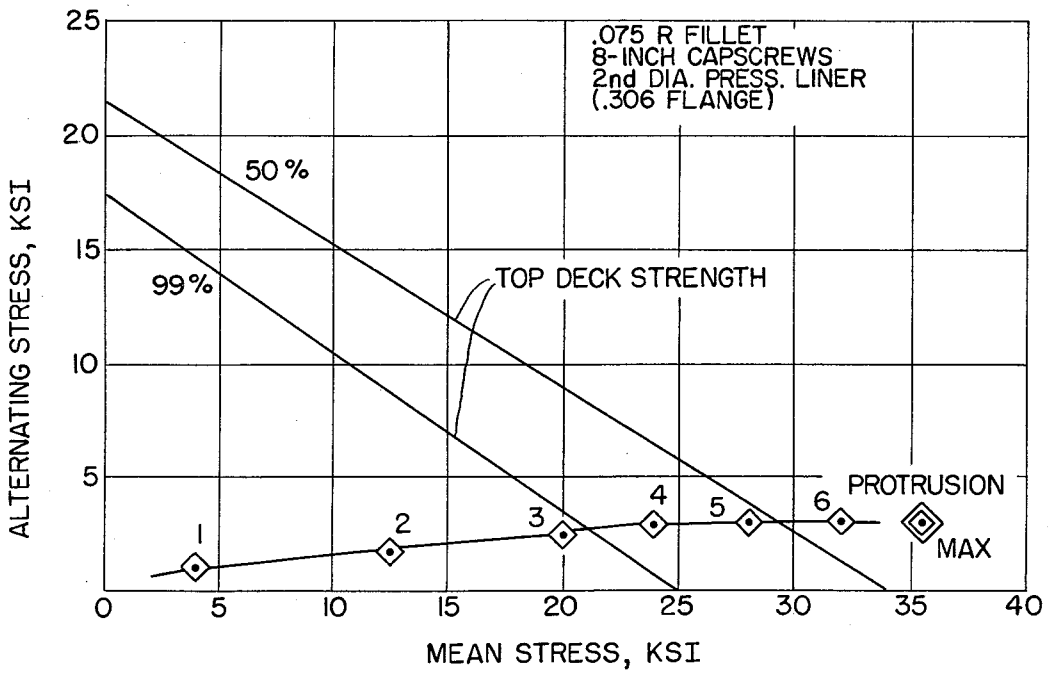
FIG. 4 is a graph of mean stress versus alternating stress showing sensitivity to liner protrusion for a top stop liner assembly as illustrated in FIG. 3.

The joint model of FIG. 2 may now be employed to analyze the characteristics of the conventional type of top stop cylinder liner illustrated in FIG. 3. The assembly of FIG. 3 includes a cylinder liner 40 including an outwardly radially directed flange 42 positioned adjacent the outermost end of the cylinder liner 40. A cylinder cavity 44 formed in engine block 46 receives liner 40 and includes a counterbore 48 shaped to receive the outwardly radially directed flange 42. The depth of counterbore 48 is carefully controlled relative to the axial length of flange 42 to cause the upper surface of flange 42 to protrude above the upper surface 50 of engine block 46. The amount of protrusion controls the compressive force applied to flange 42 when the engine head 52 is pulled into operative position by a plurality of head bolts 54 (only one of which is illustrated in FIG. 3) threadedly connected to engine block 46. A head gasket 56 is positioned between the lower surface of head 52 and the upper surface 50 of the engine block 46. A combustion gas seal ring 60 is formed between the upper surface of flange 42 and the corresponding portion of the lower surface of head 52. The body 58 of gasket 56 is positioned between the head 52 and engine block 46. FIG. 4 is a plot of the actual measured data showing counterbore stress for a top stop liner/block assembly of the type illustrated in FIG. 3 wherein the stress is measured at the fillet between the cylinder surface and the bottom surface of the counterbore with the fillet having a 0.075 inch radius, the flange 42 having a radial extent of 0.306 inches. It is apparent from FIG. 4 that the block counterbore fillet is subjected to severe stress.

Figure 5:
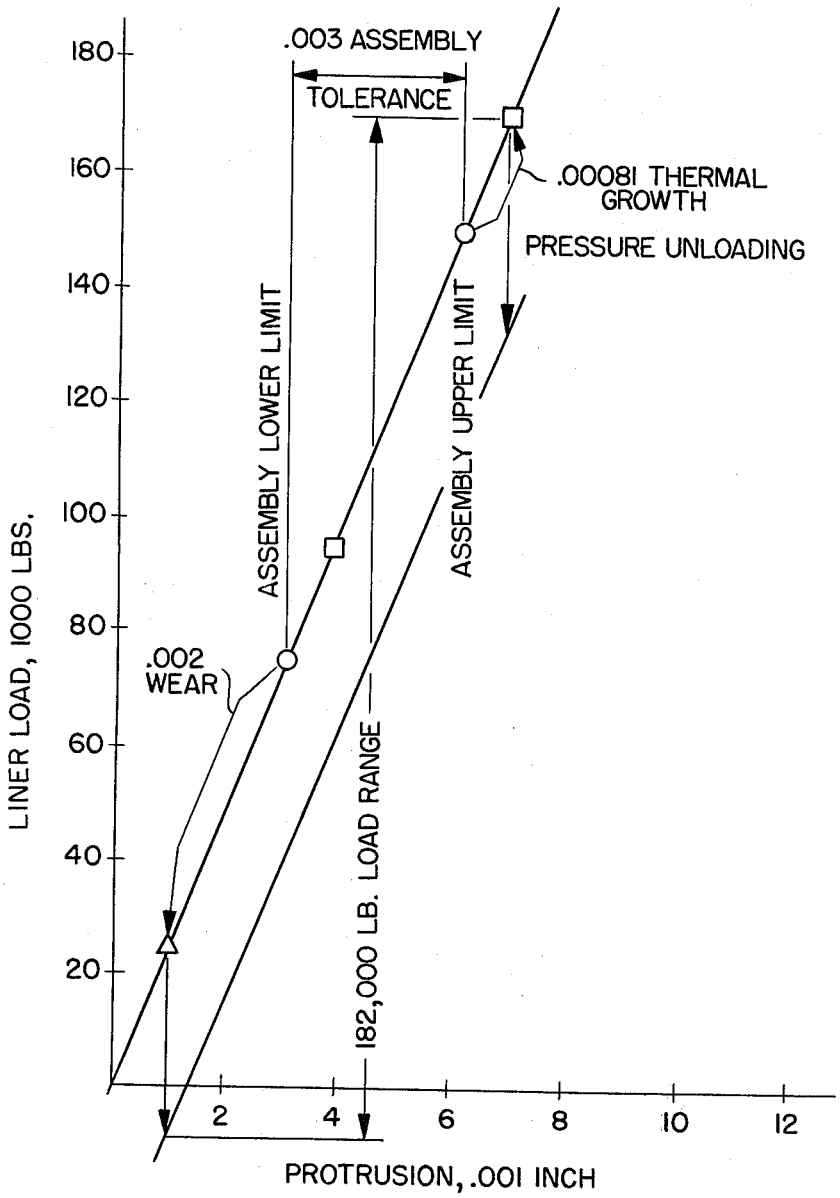
FIG. 5 is a load map for a top stop liner assembly as illustrated in FIG. 3.
Figure 6:
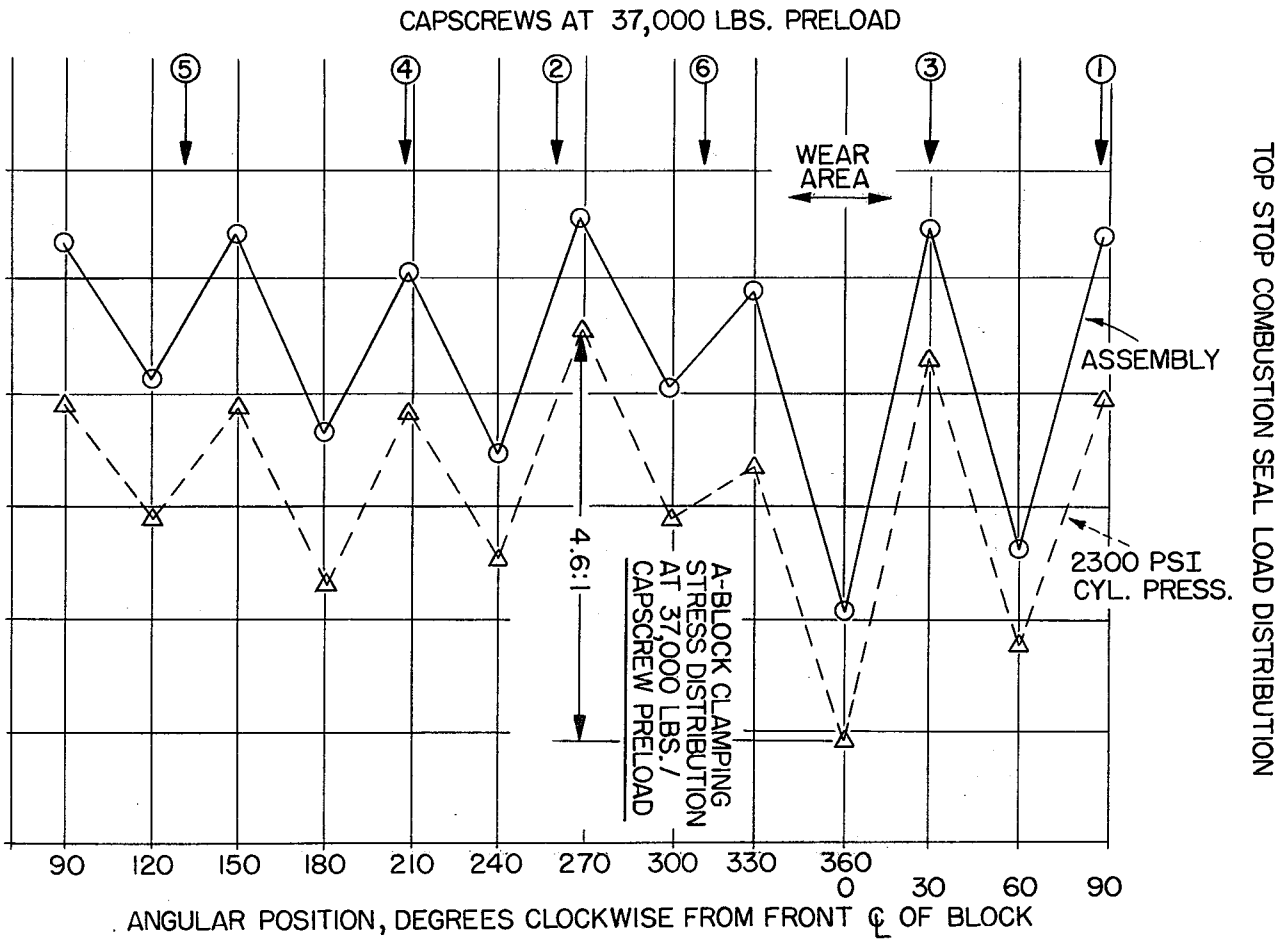
FIG. 6 is a top stop combustion seal load distribution graph for a liner assembly as illustrated in FIG. 3 wherein six head bolts are assumed to be distributed angularly around the circumference of the liner.

Using the model of FIG. 2, and the assumption that the nominal contact areas for an assembly such as illustrated in FIG. 3 could be exemplified by a combustion contact seal area of 2.44 square inches, a head block contact area of 2.65 square inches and a head gasket body area of 29.17 square inches, the alternating load due to a maximum combustion gas pressure of 2400 lbs. per sq. inch would result in a combustion seal alternating stress of 15,050 lbs. per square inch, a head bolt alternating stress of 3620 lbs. per square inch and an alternating body stress of 940 lbs. per square inch. Obviously a very severe nonunformity in load response to cylinder pressure exists in a joint system of the type illustrated in FIG. 3. Referring now to FIG. 5, a load map of the type disclosed and discussed in a co-pending application Ser. No. 959,702, filed Nov. 13, 1978, now U.S. Pat. No. 4,244,330 and assigned to the same assignee as the subject application, is illustrated. All of the disclosure of this co-pending application is incorporated herein by reference. FIG. 5 demonstrates that for a top stop liner such as illustrated in FIG. 3, an extremely severe load range exists dependent upon flange protrusion, liner wear and thermal growth. This range can be 182,000 lbs for a typical embodiment of the type of liner illustrated in FIG. 3. Finally, reference is made to FIG. 6 in which a typical seal load distribution around the circumference of a top stop cylindrical liner assembly employing six cap screws is plotted as a function of angular position. As is apparent from FIG. 6, an extremely large ratio (4.6:1) between the maximum and minimum seal pressures result from the short structural distance between the point of threaded engagement of the cap screws with the engine block and the combustion gas ring seal 60 (FIG. 3) through which the compressive load force is applied to the combustion gas seal ring. This short structural distance is illustrated by arrow A in FIG. 3.

Figure 7:
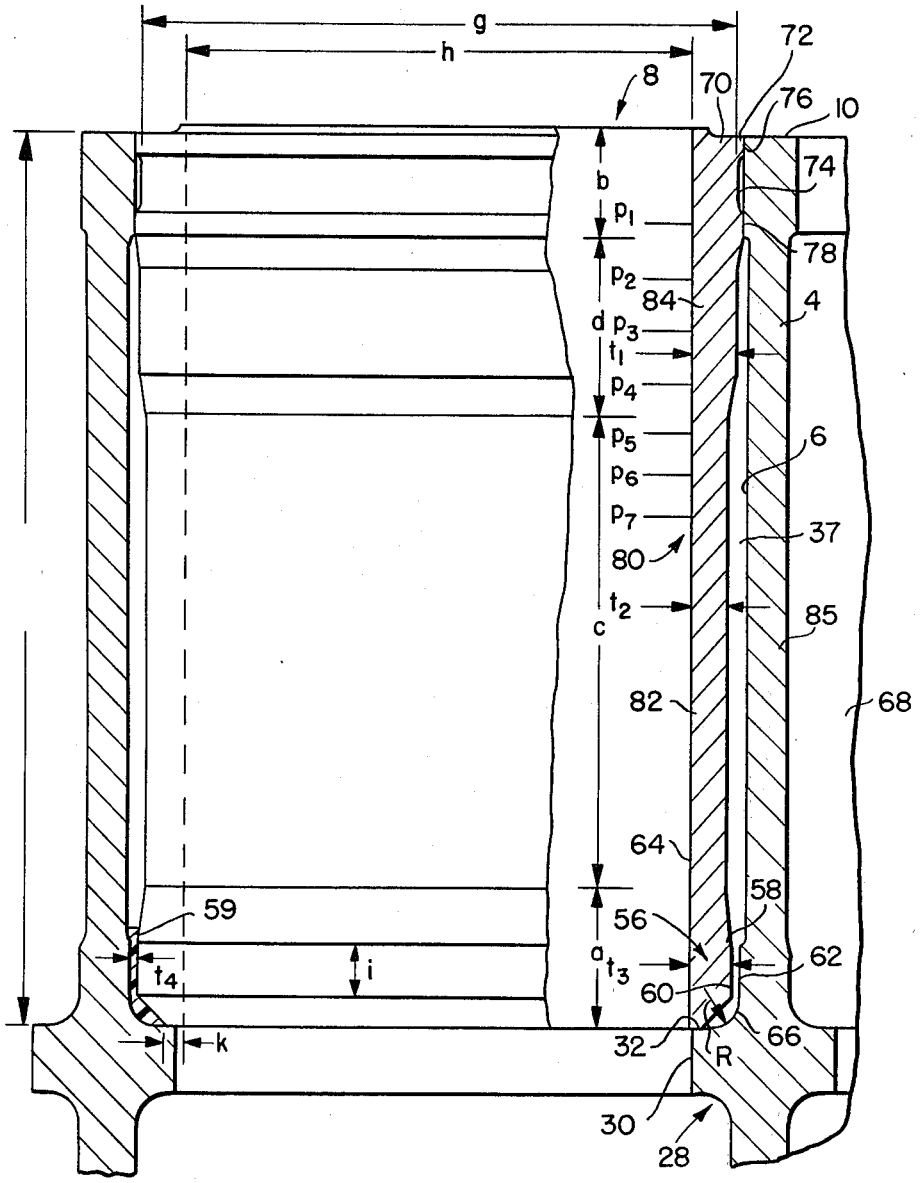
FIG. 7 is a broken away cross sectional view of a bottom stop liner and engine block designed in accordance with the subject invention.

To understand how the subject liner/block assembly of the subject invention overcomes the disadvantages of a top stop liner configuration as described above with reference to FIGS. 3 through 6, attention is now directed to FIG. 7 in which the liner and block design illustrated in FIG. 1 has been enlarged so that the important structural characteristics can be more easily understood. FIG. 7 illustrates an engine block 4 containing a cylinder cavity 6 within which the bottom stop liner 8 of FIG. 1 is disposed. The inner end of cylinder liner 8 forms an axial positioning means 56 for axially positioning the cylinder liner within the cylinder cavity 6. The axial positioning means 56 includes the radially directed surface 32 adjacent the inner end of the cylinder liner for engaging the liner stop 28. Also, the axial positioning means 56 includes an inner end boss 58 (extending for an axial distance a) adjacent the innermost end of cylinder liner 8 and includes a radially thickened wall portion having an exterior cylindrical locating surface 60 which defines the maximum radial extent of the inner end boss 58. The cylinder cavity 6 includes a corresponding cylindrical interior locating surface 62 positioned adjacent to and on the outward side of liner stop 28. The radius of the interior locating surface 62 is slightly greater than the radius of the exterior locating surface 60 to form a predetermined clearance space which may be filled with a settable plastic material 59 (shown only on the left side of FIG. 7) to provide radial support and an improved coolant impervious seal between the liner and the engine block 4.

As is evident from FIG. 7, the innermost end face 32 of the liner commences at the interior surface 64 of the cylinder liner and extends for a radial distance which is significantly less than the maximum radial extent of the inner end boss 58. A bevel surface 65 at an angle $\alpha$ (equal to about 45°) extends between end face 32 and interior locating surface 62. By this arrangement, the axial compression forces imparted to the cylinder liner 8 by the engine head (not illustrated) will be concentrated on a small cross-sectional area of contact between the innermost end face 32 and the upper surface of liner stop 28 to form a coolant impervious seal between these two surfaces. Moreover, by placing the contact surface as close as possible to the interior of the cylinder liner, a large radius fillet 66 may be formed between the interior locating surface 62 and the portion of the liner stop 28 which contacts the radially directed surface 32. This large radius, represented by R, tends to reduce the stress sensitivity of the liner stop to axial compression loads imparted to the cylinder liner during assembly and operation. This same result, of course, could be obtained by increasing the radius of cylindrical surface 62. However, proceeding in this manner, would require the spacing between cylinder cavity 6 and the adjacent cylinder cavity 68 to be equally increased if the necessary wall thickness between the cylinder cavities is to be maintained. In top stop liner designs, the amount of room available for forming the counterbore fillet is extremely limited and has prompted a compromise in which the fillet radius has been reduced below a comfortable margin. This drawback of the top stop liner design has been completely obviated by the full bottom stop liner configuration illustrated in FIG. 7 without requiring an overall increase in length of the engine block. The axial extent of the axial positioning means 56 is represented by the letter a. Still another advantage of the full bottom stop configuration of FIG. 7 is that no bending movement is imparted to the walls of the liner when compressively loaded as is the case with top and mid stop liners employing radially directed flanges.

The outermost end of the cylinder liner 8 forms a radial positioning means 70 for radially positioning the outer end of the cylinder liner 8 within cylinder cavity 6, thereby reducing substantially axial constraint at the outer end relative to the adjacent portions of the engine block 4. As noted above, this portion of the cylinder liner is designed to form a radial press fit with corresponding portions of the cylinder cavity. Radial positioning means 70 includes an outer end boss 72 adjacent the outermost end of the cylinder liner 8. The outer end boss 72 includes an outside cylindrical surface having a diameter f slightly greater than the inside diameter e of the cylinder cavity 6 adjacent the outer end boss 72. The radial difference in these two surfaces is adjusted to cause a tight coolant impervious press fit to form completely around the outer end boss 72 when the liner 8 is pushed into operative position within the cylinder cavity 6. For reasons discussed more fully in the above-identified co-pending application Ser. No. 959,702, the outside cylindrical surface of outer end boss 72 contains a recess 74 for dividing the outer surface of the outer end boss 72 into two spaced cylindrical surfaces 76 and 78. As is fully disclosed in the co-pending application, an arrangement of this type produces the desired press fit characteristics while simultaneously providing the necessary radial support to the outermost portion of the cylinder liner 8 which is subjected to the highest combustion gas pressure during engine operation and therefore requires the greatest radial support.

The axial extent of outer end boss 72 is represented by letter b. Extending between the axial positioning means 56 and the radial positioning means 70 is a resilient liner body 80 integral with the axial and radial positioning means 56,72. Liner body 80 operates to apply axial spring force between liner stop 28 and the engine head, not illustrated in FIG. 7, to place under tensile force that portion of the engine block 4 surrounding the cylinder cavity 6 and extending between liner stop 28 and head engaging surface 10 (other than the portion above the threaded engagement of the head bolts, FIG. 9) as the engine head is connected to the engine block and moved into operative position. The thickness of the engine block walls 85 which interconnect the head engaging surface 10 with the liner stop 28 is adjusted and controlled to insure that the axial compliance thereof is substantially greater than the axial compliance of the cylinder liner. From a consideration of the elastic model illustrated in FIG. 2, an increase in the relative axial compliance of the cylinder liner 8 will have the result of causing compression load changes to be transferred to the engine block 4 which thus substantially reduces the alternating combustion seal load which would otherwise be transmitted through the liner 8 and combustion gas seal ring (not illustrated). Given no other considerations, an ideal cylinder liner 8 would have extremely high compliance. Increased compliance can be achieved in a full bottom stop liner of the type illustrated in FIG. 7 by decreasing the radial wall thickness of the liner body. However, as can be readily understood, the liner body must also be sufficiently stiff to resist deformation pressure which would cause excessive piston ring wear and combustion gas leakage. The deforming pressure to which any portion of the cylinder liner is subjected is a function of the maximum compresson pressure reached at any given point along the axial length of the combustion chamber 22 (FIG.1) formed by the interior surface 64 of the cylinder liner between the opposed surfaces of the engine head and reciprocating piston contained within the cylinder liner. Chart I is representative of the maximum gas pressures existent at seven different axial positions along the length of the interior surface 64 of the cylinder liner identified in FIG. 7 by letters $P_1$ through $P_7$. These various axial positions correspond to the positions of a top piston ring when the crankshaft is at the crank angle indicated in Chart I.

CHART I

| Axial Position of Top Piston Ring | Maximum Gas Pressure (PSI) | Crank Angle |
|---|---|---|
| $P_1$ | 2400 | Top Dead Center |
| $P_2$ | 1460 | 385° |
| $P_3$ | 940 | 398 |
| $P_4$ | 600 | 410 |
| $P_5$ | 400 | 420 |
| $P_6$ | 300 | 430 |
| $P_7$ | 200 | 440 |

To avoid excessive liner wall distortion, increased radial wall thickness is provided along the axial length of the liner in rough correspondence to the maximum expected gas pressure which will exist at that position during engine operation. For practical reasons, the radial wall thickness may be increased in steps to thereby lessen manufacturing cost which would otherwise result if the interior wall of the cylinder liner were provided with a continuously varying radial diameter. As is clearly shown in FIG. 7, the liner body is formed in two parts, including an inner portion 82 extending outwardly from the axial positioning means 56 for a substantial portion of the total axial length of the cylinder liner 8 which in the embodiment illustrated in FIG. 7 is approximately 70 percent of the total axial length of the liner 8. The remaining section of the liner body is formed by an outer portion 84 including the remaining outward extent of the cylinder liner 8 up to the radial positioning means 70. The axial extents of the inner and outer portions of the cylinder body illustrated in FIG. 7 are represented by the letters c and d respectively.

In Chart II, exemplary dimensions for a cylinder liner and block assembly of the type illustrated in FIG. 7 are listed in inches. Obviously, these representative dimensions could be varied somewhat to accommodate specific requirements of a particular engine design. However, the axial length c of the inner portion 82 should preferably be in excess of 60 percent of the total axial length of the liner.

CHART II

| | |
|---|---|
| $t_1$ | .320–.330 |
| $t_2$ | .295–.305 |

CHART II-continued

| | |
|---|---|
| $t_3$ | .387–.388 |
| $t_4$ | .000–.004 |
| a | 1.4 |
| b | 1.244–1.311 |
| c | 7.8 |
| d | 1.5 |
| e | 7.047–7.049 |
| f | 7.050–7.052 |
| g | 6.960–6.980 |
| h | 6.250 ref. |
| i | 11.9985–12.0015 |
| j | 11.9875–11.9905 |
| k | .180–.200 |
| l | 45°–50° |

Figure 9:
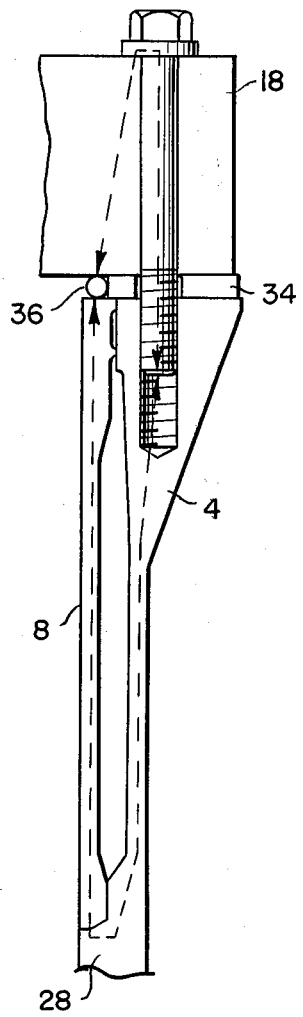
FIG. 9 is a broken away, cross-sectional view of a bottom stop liner/engine block/head/ head gasket assembly designed in accordance with the subject invention.

It is now possible, employing the elastic model illustrated in FIG. 2, to analyze a bolted joint assembly having the configuration illustrated in FIGS. 7 and 9 in order to assess the effect of such factors as thermal growth, load due to combustion, liner protrusion and protrusion tolerance. If a standard steel plate head gasket is employed and the cylinder head geometry, cylinder head bolts, bolt torque, cylinder bolt depth in the block and material compositions are not changed from that normally employed in a conventional top stop assembly, as illustrated in FIG. 3, the following conclusions can be reached. The axial thermal growth of the liner calculated from expected maximum liner temperature distribution data, indicates that a liner having the dimensions listed in Chart II would have an axial thermal growth of approximately 0.006 inches in excess of the vertical thermal growth of block 4 between the liner stop 28 and the head engaging surface 10. Such a differential thermal growth would act as an apparent protrusion increase during operation of the engine. Axial wear in a full bottom stop liner should be less than in a top stop system but for purposes of analysis the axial wear will be assumed to be 0.002 inches.

The minimum protrusion value necessary to obtain sufficient combustion gas sealing may be determined by minimum required nominal compression fuel load, during combustion, when a minimum assembly protrusion system is worn the full 0.002 inches allowed. For the engine assembly illustrated in FIG. 1, the minimum combustion seal load can be assumed to be approximately 10,000 lbs. This nominal seal loading would be insufficient for a top stop system wherein the circumferential non-uniformity in the seal load is quite severe. However, because of the advantages of the subject full bottom stop assembly illustrated and discussed with reference to FIG. 9 below, the 10,000 lb. nominal seal load figure is believed to be comfortably adequate. The maximum protrusion value is limited by the maximum allowable block counterbore fillet stress. For a block counterbore fillet stress limit of 15 ksi (60% of minimum ultimate strength) the maximum allowable cylinder load is 50,000 lbs. All of the above considerations may be combined as follows. To meet the 10,000 lb minimum seal load requirement, the minimum worn protrusion limit must be 0.00666 inches. To meet the 50,000 lb maximum liner load criteria, the maximum total apparent protrusion limit must be 0.0136 inches. The difference between the minimum and maximum protrusion (0.0070 inches) must be distributed proportionately among wear tolerance (0.0020 inches), thermal growth (0.0060 inches) and some allowance for a protrusion tolerance band. Simple arithmetic reveals this system is not workable. Even without the necessary machine tolerances for the various components, the gains due to increased liner and block compliance have been more than absorbed by the wear tolerance and thermal growth of the liner.

In order to form a workable system from the design concept illustrated in FIG. 7, it is necessary to introduce additional joint system compliance in one of the two remaining components effecting protrusion sensitivity, i.e. the cylinder head or the head gasket. Because the cylinder head performs several functions in addition to loading the combustion seal, many of which are inconsistent with high compliance characteristics, the head gasket must be looked to provide the requisite increased system compliance. The head gasket must have a relatively stiff body so as not to upset the combustion load bias away from the combustion sel which is designed into the relative liner and upper block compliances. Also, the stiff body would have a minimal and predictable influence on the apparent protrusion of the liner over the block. In some cases, the gasket body should have a high co-efficient of friction to inhibit motion between the head and gasket and between the gasket and block. The bottom stop system requires a combustion seal with a high intensity contact stress (lbs, per square inch). The contact stress should increase rapidly with load increases until some threshold is reached and then stabilize. The combustion seal should have very high compliance on assembly to absorb protrusion variations, but the combustion seal compliance during engine operation should be considerably smaller than the compliance of the liner to avoid excessive alternating strains in the seal.

Figure 8A:
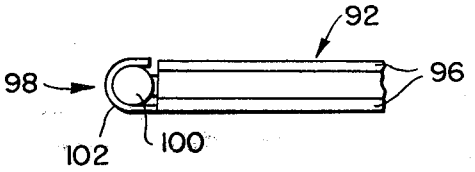
FIG. 8*a* is an enlarged broken away, cross sectional view of the head gasket illustrated in FIG. 1.

Gaskets which meet the above criteria are commercially available, manufactured by Fel-Pro, Skokie, Ill. and are of the type illustrated in FIG. 8*a*. The gasket 92 includes a steel body 94 having a composition overlay 96 having the desired high co-efficient of friction. The combustion seal ring 98 is formed by a steel wire ring 100 which is protected by a thin stainless steel armor 102. The wire ring 100 initially has only a line of contact and so produces the high contact stress when lightly loaded. As the load is increased, the wire ring yields and flattens at the contact location. The yielding maintains the contact stress at high (but avoids excessive) levels. Furthermore, yielding of the wire ring entails plastic deformation of the ring. The plastic deformation of the wire ring combines with the elastic deformation to produce a very high apparent assembly compliance, as required. When the yielded wire is unloaded in response to combustion pressure, only the elastic portion of the assembly deformation will rebound. Insofar as the proportion of the assembly deformation which is elastic is quite small, the compliance seen by combustion pressures will be several times smaller than the assembly compliance. The decreased compliance of the wire ring during operation will be greater than the linear compliance as required. Gaskets of this type manufactured by Fel-Pro are identified as FELCOPLY L-2205 with mild steel gas seal rings.

When a gasket of the type described in reference to FIG. 8*a* is employed in the assembly illustrated in FIGS. 1 and 7, a system achieving all of the desired goals is formed.

Figure 8B:
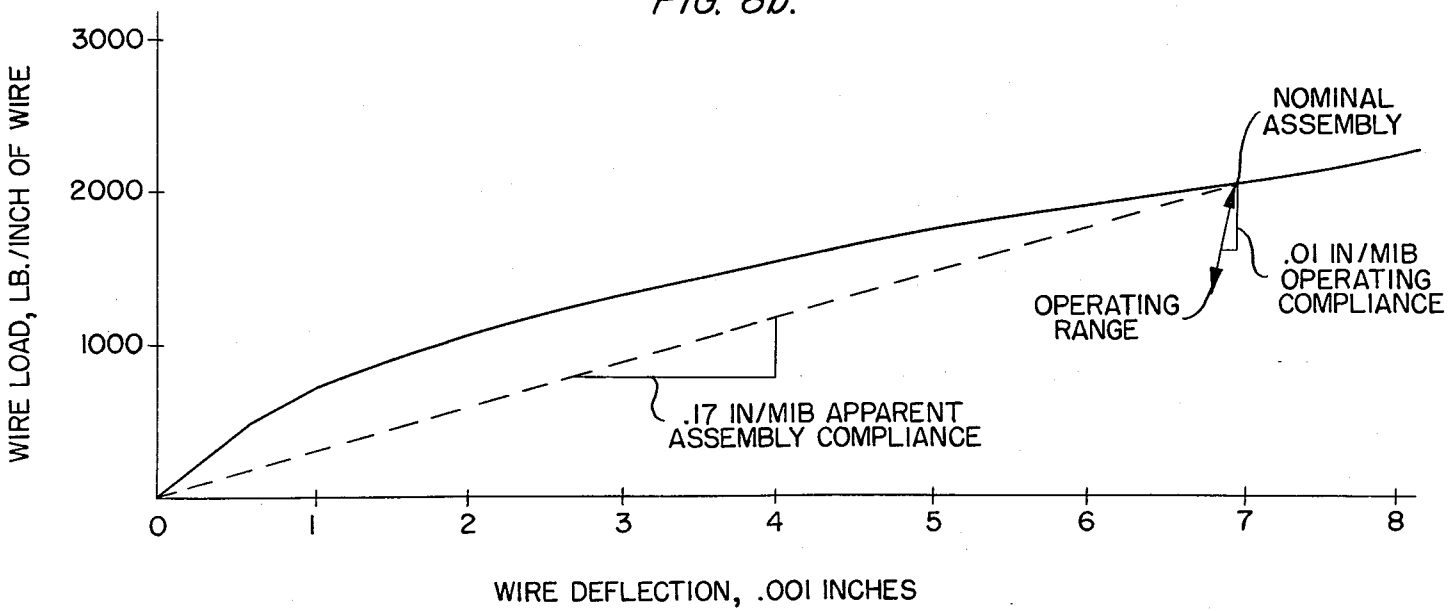
FIG. 8*b* is a graph of load versus deflection for the combustion gas seal ring of the head gasket illustrated in FIG. 8*a;*

FIG. 8*b* is a graph of the characteristics of a head gasket having the structural features illustrated in FIG. 8*a*. This graph shows that the apparent assembly compliance is 17 times greater than the operating compliance.

Figure 10:
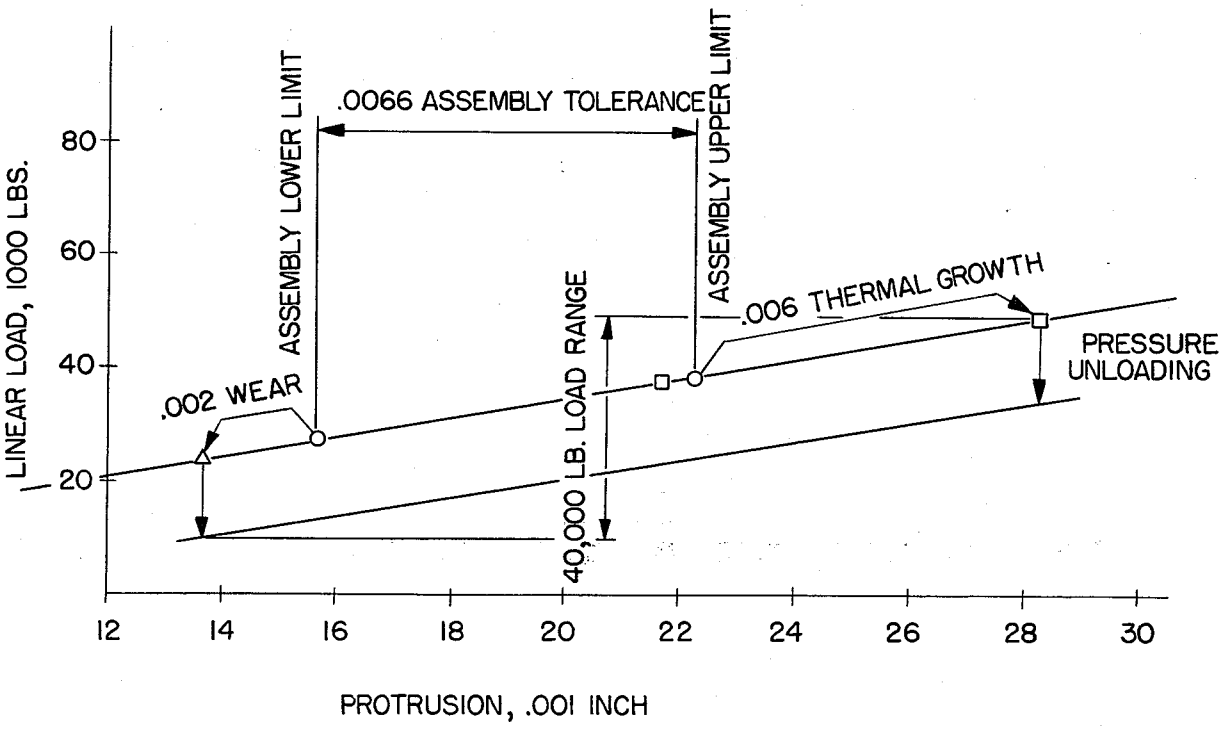
FIG. 10 is a graph of a load map for a bottom stop liner and head gasket of the type illustrated in FIGS. 1, 7 and 9.

FIG. 9 is a schematic illustration of the dramatically increased structural distance from the thread engagement of the cap screws with the cylinder block to the combustion seal in a bolted joint assembly of the type illustrated in FIG. 1. For an assembly having the total length dimensions listed in Chart II, the distance through the portion of the cylinder block placed under tension plus the length of the liner placed under compression equals a total of over 22 inches, it can thus be appreciated that a far greater circumferential uniformity can be obtained in the seal pressure exerted around the circumference of the combustion gas seal ring 36. FIG. 10 illustrates a load map of the type illustrated in FIG. 5 for the cylinder liner and engine block assembly illustrated in FIGS. 1, 7 and 9. It is apparent from this load map that the total load range imposed on the liner has been dramatically reduced from 182,000 lbs to 40,000 lbs.

If the following nominal contact areas are assigned to the combustion seal, head bolts, and body of the assembly illustrated in FIGS. 1 and 7, the resulting alternating stress distribution may be calculated using the elastic bolted joint model of FIG. 2. If the combustion seal is assumed to have a nominal contact area of 5.22 square inches, the head bolts are assumed to have a nominal contact area of 2.65 square inches and the gasket body is assumed to have a nominal contact area of 29.20 square inches, the alternating stresses due to a combustion gas loading of 2400 lbs. per square inch would be: 2740 psi for the combustion seal, 930 psi for the head bolts, and 1950 psi for the body. These figures compare extremely favorably with the figures calculated for the top stop configuration of FIG. 3 referred to above.

In summary, the assembly of FIGS. 1 and 7 achieves a combustion seal alternating load reduction of one half of the top stop value, a maximum block counterbore fillet stress reduction to less than half the top stop value, minimum combustion seal load is maintained even after 0.002 inches of wear and thermal growth of the liner is accommodated and the combustion loads are distributed much more uniformly throughout the structure. In addition, the combustion seal load may be reduced approximately one third, thereby reducing assembly stresses in the cylinder head leading to a substantial reduction of head cracking. The head bolt alternating load is reduced to 26 percent of the top stop load. This reduction will greatly enhance the reliability of the bolts and should also allow cost reduction. The relative motion between the top of the liner and the adjacent block wall is reduced to 24 percent of the top stop motion. This will lead to negligible long term radial wear. The minimum gasket body load is double the top stop body load and will produce a more intimate head/gasket/body/block joint which will help insure the integrity of the entire system. The body fluid seals will be more reliable and the increased body load, in conjunction with the high friction gasket surfaces, will greatly inhibit transverse relative motion between the head and body and between the body and block which will in turn contribute to the body reliability and the reduction of head and block wear. Because the liner is machined from a lighter casting, and the machining is simpler plus the O-ring and crevice seals of the top stop configuration are eliminated, a more accurate component at reduced cost is possible.

Figure 11:
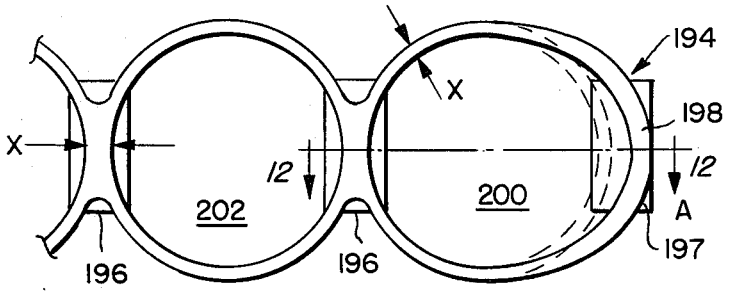
FIG. 11 is a top elevational view of an engine block containing plural cylinder cavities designed in accordance with the subject invention.

The circumferential uniformity in combustion gas seal loading referred to with respect to FIG. 9 depends in part upon the portions of the engine block surrounding each cylinder cavity having a substantially circumferentially uniform compliance. This may be achieved by a configuration such as illustrated in FIG. 11 wherein an engine block 194 is illustrated containing plural aligned cylinder cavities 200, 202 extending outwardly from a crankshaft toward a head engaging surface. Each of the cylinder cavities would have a configuration such as illustrated in FIG. 7 and the central axes of the respective cylinder cavities are parallel and coplanar as in a conventional, in-line, or in each bank of a Vee type internal combustion engine. In order to assure uniform circumferential compliance, the cylinder walls defining the individual cylinder cavities should have substantially uniform radial thickness with the walls joined tangentially between adjacent cylinder cavities to cause adjacent cylinder cavities to be separated by a distance equal to twice the radial thickness of the cylinder walls. This relationship is illustrated in FIG. 11 by letter "X" representing the cylinder wall thickness and the letter ¢2X" referring to the wall thickness between adjacent cylinder cavities.

Figure 12:
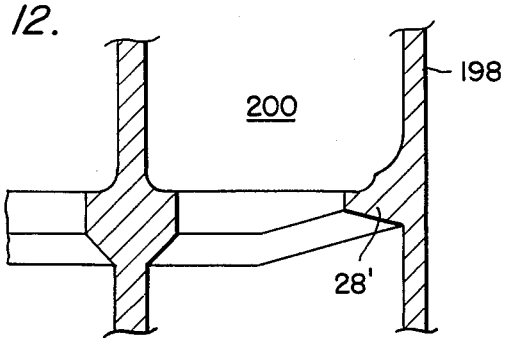
FIG. 12 is a partial cross sectional view of the engine block of FIG. 11 taken along lines 12—12.

The cylinder block illustrated in FIG. 11 is also provided with plural aligned main saddle bearings 196 positioned inwardly from the inner sections of the cylinder wall and the end wall portion 198 which intersects with the lateral end wall of the engine block. A similar end wall portion would be formed at the opposite end of the aligned row of cylinder cavities adjacent the opposite end of the engine block. As can be readily appreciated from FIG. 11, it would be necessary to increase the thickness of wall portion 198 in order to match the engine block compliances between each main cap bearing 196 and the top deck or head engaging surface. Such a thickening of wall 198 could lead to a non-uniformity in the compliance between the head engaging surface of the block and the liner stop formed in the end cylinder cavities 200. This problem is solved by the structure illustrated in FIG. 12 where it is shown that the end wall portion 198 has been moved laterally outwardly and the axial extent of the liner stop 28' adjacent the end wall 198 has been reduced. These two expedients result in a softening relative to the remaining portion of the liner stop to a degree sufficient to provide circumferentially uniform compliance in the supporting portions of the engine block between the inner end of the cylinder line received in the end cylinder cavity 200 and the head engaging surface of the cylinder block.

By virtue of this novel full bottom stop liner and corresponding engine block design described above, numerous structural problems associated with internal combustion engine cylinder liners have been solved. In particular, cracking of the liner flange, counterbore fillet and cylinder head is significantly reduced, head bolts and combustion seal ring fatigue/failure has been reduced and block/liner wear and head/block wear have been reduced. Other advantages are also apparent from the above description.

I claim:

1. An assembly for use with an internal combustion engine having a reciprocating piston connected to a rotating crankshaft, comprising (A) an engine block having a head engaging surface and at least one cylinder cavity extending outwardly from the crankshaft toward said head engaging surface, said engine block including a liner stop extending radially inwardly at the inner end of said cylinder cavity, (B) head means for closing the outer end of said cylinder cavity when connected to said engine block and moved into an operative position adjacent said head engaging surface; and (C) a cylinder liner positioned within said cylinder cavity for guiding the reciprocating movement of the piston, said cylinder liner being held under compressive force by said head means, said cylinder liner including (1) axial positioning means for axially positioning said cylinder liner within said cylinder cavity, said axial positioning means including a radially directed surface adjacent the inner end of said cylinder liner for engaging said liner stop, and (2) compressive force sustaining means for minimizing the release of compressive force on said cylinder liner due to gas pressure within said cylinder cavity, said compressive force sustaining means including (a) radial positioning means for radially positioning the outer end of said cylinder liner within said cylinder cavity while reducing axial constraint of said outer end within said cylinder cavity during engine operation by forming a radial press fit with the inside surface of the adjacent portion of said cylinder cavity, and (b) a resilient liner body integral with and extending between said axial and radial positioning means, operating to apply axial spring force between said liner stop and said head means to place the portion of said engine block surrounding said cylinder cavity and extending between said liner stop and said head engaging surface under tensile force as said head means is connected to said engine block and moved into operative position, said liner body and said axial and radial positioning means having an axial compliance which is greater than the axial compliance of said surrounding portion of said engine block, the greater axial compliance of said liner body operating to cause the axial length of said liner body to change more than the axial length of said surrounding portion of the engine block when the liner body and the engine block are subjected to the same amount of force.

2. An assembly as defined in claim 1, wherein said liner body includes an inner portion extending outwardly from said axial positioning means for a substantial portion of the total axial length of said cylinder liner, said inner portion having uniform minimal radial wall thickness, and an outer portion including the remaining outward extent of said cylinder liner out to said radial positioning means, said outer portion having a radial wall thickness which increases with increased axial distance from the inner end of said cylinder liner in proportion to the upper limit of gas pressure to which the interior of said cylinder liner at the corresponding axial position is subjected.

3. An assembly as defined in claim 2, wherein said inner portion includes at least 60 percent of the total axial length of said cylinder liner.

4. An assembly as defined in claim 1, wherein the exterior surface of said liner body is spaced from the interior surface of a corresponding portion of the interior surface of said cylinder cavity to form a coolant passage for providing coolant to said exterior surface of said liner body, and wherein said radial positioning means includes an outer end boss adjacent the outermost end of said cylinder liner, said outer end boss including an outside cylindrical surface having a diameter slightly greater than the inside diameter of the cylinder cavity adjacent said outer end boss to form a coolant impervious press fit completely around said outer end boss between the inside surface of said cylinder cavity and said cylinder liner when said cylinder liner is placed within said cylinder cavity.

5. An assembly as defined in claim 4, wherein said axial positioning means includes an inner end boss adjacent the innermost end of said cylinder liner, said inner end boss having a maximum radial wall thickness which is substantially greater than the radial wall thickness of said inner portion, said radially directed surface being formed on the innermost end face of said cylinder liner commencing at the interior surface of said cylinder liner and extending for a radial distance which is less than the radial wall thickness of said inner portion, said radially directed surface forming a cooling impervious seal with said liner stop when said cylinder liner is biased with sufficient axial force against said liner stop.

6. An assembly as defined in claim 5, wherein said cylinder cavity includes a cylindrical interior locating surface adjacent said liner stop, and wherein said inner end boss includes a cylindrical exterior locating surface positioned to fit within said cylindrical interior locating surface, said cylindrical exterior locating surface having a uniform radius equal to the maximum radial extent of said inner end boss, said end boss including a beveled surface interconnecting said cylindrical exterior locating surface and said radially directed surface.

7. An assembly as defined in claim 6, wherein the radius of said exterior locating surface is less than the radius of said interior locating surface to form a predetermined clearance space, said predetermined clearance space being filled with a settable plastic material.

8. An assembly as defined in claim 6, wherein the radial extent of said radially directed surface is less than the radial extent of said beveled surface, said cylinder cavity including a fillet surface extending between said exterior locating surface and the portion of said liner stop which contacts said radially directed surface, said fillet surface having a radius of curvature which is greater than the radial extent of said portion of said liner stop which contacts said radially directed surface.

9. An assembly as defined in claim 1, wherein said cylinder liner includes an outer face generally perpendiculr to the central axis of said cylinder liner, and further including a gasket means for forming a combustion gas seal between said head means and said outer end face, said gasket means including a seal ring disposed between said outer end face an said head means, said seal ring having a high non-resilient deformation giving rise to a predetermined ring assembly compliance as said head means is moved into said operative position during assembly and a ring operating compliance substantially less than said ring assembly compliance and substantially less than the axial compliance of said cylinder liner.

10. An assembly as defined in claim 9, wherein said ring assembly compliance is more than ten (10) times greater than said ring operating compliance.

11. An assembly as defined in claim 10, wherein said gasket means includes a gasket body shaped to be disposed between said head means and said head engaging surface of said engine block, said gasket body having a compliance substantially below the axial compliance of said cylinder liner, and said gasket body includes outer surfaces having a coefficient in friction in excess of 0.3.

12. An assembly as defined in claim 1, wherein said engine block contains plural additional cylinder cavities extending outwardly from the crankshaft toward said head engaging surface and corresponding liner stops extending radially inwardly at the inner end of said corresponding cylinder cavities, said cylinder cavities being positioned to cause their central axes to be parallel and co-planar, and further including additional cylinder liners identical to said first identified cylinder lines disposed in said additional cylinder cavities, respectively, said head means being shaped to close the outer end of said additional cylinder cavities when connected to said engine block in an operative position adjacent asid head engaging surface to hold said corresponding liners under compressive force and to place the portions of said engine block surrounding said additional cylinder cavities extending betweeen said additional liner stops and said head engaging surfae under tensile force as said head means is connected to said engine block and moved into operative position, said additional liner bodies having axial compliance which are substantially greater than the axial compliances of said corresponding surrounding portions of said engine block, each said surrounding portion and each said cylinder liner having a circumferentially uniform compliance during assembly and operation to insure even combustion gas seal forming pressure between the outer end of each cylinder liner and said head means.

13. An assembly as defined in claim 12, wherein said surrounding portions are formed by cylinder walls having substantially uniform radial thickness, said cylinder walls joining tangentially between adjacent cylinder cavities to cause adjacent cylinder cavities to be separated by a distance equal to twice the radial thickness of said cylinder walls.

14. An assembly as defined by claim 13, wherein the end cylinder cavities of said plural cylinder cavities include end wall portions which interact with the end walls of said engine block and wherein said engine block includes plural aligned main bearing saddles for the engine crankshaft, said main bearing saddles being positioned inwardly from the intersections of said cylinder walls and said end wall portions, respectively, said end wall portions being increased in thickness to tend to even out the compliance characteristics of said engine block between said head engaging surface and each said bearing saddles and the corresponding portion of said liner stops adjacent said end wall portions, said end wall portions being softened relative to the remaining portion of said liner stops to a degree necessary to provide circumferentially uniform compliance in said supporting portions of said engine block between the inner ends of said cylinder liners received in said end cylinder cavities.

15. A cylinder liner for guiding the movement of a reciprocating piston within an internal combustion engien having a rotating crankshaft connected to the piston, an engine block having a head engaging surface, at least one cylinder cavity extending outwardly from the crankshaft toward the head engaging surface and a liner stop extending radially inwardly at the inner end of the cylinder cavity, and head means for closing the outer end of the cylinder cavity when connected to the engine block and moved into an operative position adjacent the head engaging surface, said cylinder liner comprising (a) axial positioning means for axially positioning said cylinder liner within the cylinder cavity and for holding said cylinder liner under compressive force when the head means is placed in operative position, said axial positioning means including a radially directed surface adjacent the inner end of said cylinder liner for engaging the liner stop, and (b) compressive force sustaining means for minimizing the release of compressive force on said cylinder liner due to gas pressure within the cylinder cavity, said compressive force sustaining means including (1) radial positioning means for radially positioning the outer end of said cylinder liner within the cylinder cavity while reducing axial constraint of said outer end within the cylinder cavity during engine operation by forming a radial press fit with the inside surface of the adjacent portion of the cylinder cavity, and (2) a resilient liner body, integral with and extending between said axial and radial positioning means, operable to apply axial spring force between the liner stop and the head means to place the portion of the engine block surrounding the cylinder cavity and extending between the liner stop and the hed engaging surface under tensile force as the head means is connected to the engine block and moved into operative position, said liner body and said axial and radial positioning means having an axial compliance which is greater than the axial compliance of the surrounding portion of the engine block in which said cylinder liner is positioned, the greater axial compliance of said liner body operating to cause the axial length of said liner body to change more than the axial length of said surrounding portion of the engine block when the liner body and the engine block are subjected to the same amount of force.

16. A cylinder liner as defined in claim 15, wherein said liner body includes an inner portion extending outwardly from said axial positioning means for a substantial portion of the total axial length of said cylinder liner, said inner portion having uniform minimal radial wall thickness, and an outer portion including the remaining outward extent of said cylinder liner out to said radial positioning means, said outer portion having a radial wall thickness which increases with increased axial distance from the inner end of said cylinder liner in proportion to the upper limit of gas pressure to which the interior of said cylinder liner at the corresponding axial position is designed to be subjected.

17. A cylinder liner as defined in claim 16, wherein said inner portion includes at least 60 percent of the total axial length of said cylinder liner.

18. A cylinder liner as defined in claim 15, wherein the exterior surface of said liner body is designed to be spaced from the interior surface of a corresponding portion of the interior surface of the cylinder cavity when placed therein to form a coolant passage for providing coolant to said exterior surface of said liner body, and wherein said radial positioning means includes an outer end boss adjacent the outermost end of said cylinder liner.

19. A cylinder liner as defined in claim 18, wherein said axial positioning means includes an inner end boss adjacent the innermost end of said cylinder liner, said inner end boss having a maximum radial wall thickness which is substantially greater than the radial wall thickness of said inner portion, said radially directed surface being formed on the innermost end face of said cylinder liner commencing at the interior surface of said cylinder liner and extending for a radial distance which is less than the radial wall thickness of said inner portion.

20. A cylinder liner as defined in claim 19, wherein said inner end boss includes a cylindrical exterior locating surface having a uniform radius equal to the maximum radial extent of said inner end boss, said end boss including a beveled surface interconnecting said cylindrical exterior locating surface and said radially directed surface.

21. A cylinder liner as defined in claim 20, wherein the radial extent of said radially directed surface is less than the radial extent of said beveled surface.

22. A cylinder liner as defined in claim 15, further including an outer end face generally perpendicular to the central axis of said cylinder liner.

* * * * *